United States Patent [19]

Silvenis et al.

[11] Patent Number: 5,071,489

[45] Date of Patent: Dec. 10, 1991

[54] FLOOR CLEANER USING DISPOSABLE SHEETS

[75] Inventors: Scott A. Silvenis, Midland, Mich.; Daniel C. Wilson, Taylors, S.C.

[73] Assignee: Dow Brands, Inc., Indianapolis, Ind.

[21] Appl. No.: 461,028

[22] Filed: Jan. 4, 1990

[51] Int. Cl.[5] ..... B08B 1/00

[52] U.S. Cl. ..... 134/42; 134/26; 15/118; 15/144 R; 15/228; 15/231

[58] Field of Search ..... 15/228, 118, 231, 144 R; 134/42, 26

[56] References Cited

U.S. PATENT DOCUMENTS

| | | | |
|---|---|---|---|
| 2,127,886 | 8/1939 | Plön | 15/231 |
| 2,205,535 | 6/1940 | Muckenhirn | 15/231 |
| 3,199,136 | 8/1969 | George | 15/231 |
| 3,991,431 | 11/1976 | Thielen | 15/228 |

*Primary Examiner*—Theodore Morris
*Assistant Examiner*—Zeinab El-Arini

[57] ABSTRACT

An apparatus and process are provided to allow floor mopping without a mop bucket. The apparatus comprises a handle pivotally attached to a member with a generally flat lower surface. The lower surface of the member has thereon frictional means which can maintain a pre-moistened fabric sheet between the surface and an area to be cleaned.

5 Claims, 2 Drawing Sheets

FLOOR CLEANER USING DISPOSABLE SHEETS

BACKGROUND OF THE INVENTION

This invention relates to the art of cleaning and more particularly to the art of floor cleaning.

The task of mopping a floor, as it has conventionally been practiced, is laborious and time consuming. Much of this difficulty is attributable to the requirement of a mop bucket. Some mops have been developed over the years to lessen the mop bucket burden, but it has not been eliminated. For example, U.S. Pat. No. 3,199,136 shows a mop using disposable sheets to lessen the frequency of bucket water changings. However, the bucket is still required. Therefore, considerable room for improvement exists within the art.

SUMMARY OF THE INVENTION

It is thus an object of the invention to provide an improved cleaning apparatus.

It is a further object of the invention to provide a floor cleaning apparatus which does not require the use of a mop bucket.

It is a further and more particular object of the invention to provide a floor cleaning apparatus using a disposable fabric cleaning sheet.

It is also an object of the invention to provide an improved floor cleaning process.

Some of these objects are accomplished by a cleaning apparatus comprising a handle, a member pivotally attached to the end of the handle having a generally flat surface with frictional means thereon, and a cleaning fabric which can be frictionally maintained between the surface and the area to be cleaned.

The process of the invention is carried out by providing an apparatus as described above, positioning the fabric between the surface and the area to be cleaned and then moving the handle and thus the fabric in a cleaning motion over the area to be cleaned.

DETAILED DESCRIPTION

In accordance with this invention, it has been found that an apparatus and process may be provided to eliminate the need for a mop bucket when mopping. While reference is made throughout the disclosure to floor cleaning, it is understood that the invention allows cleaning of other surfaces as well, such as ceilings and walls.

Figure 1:
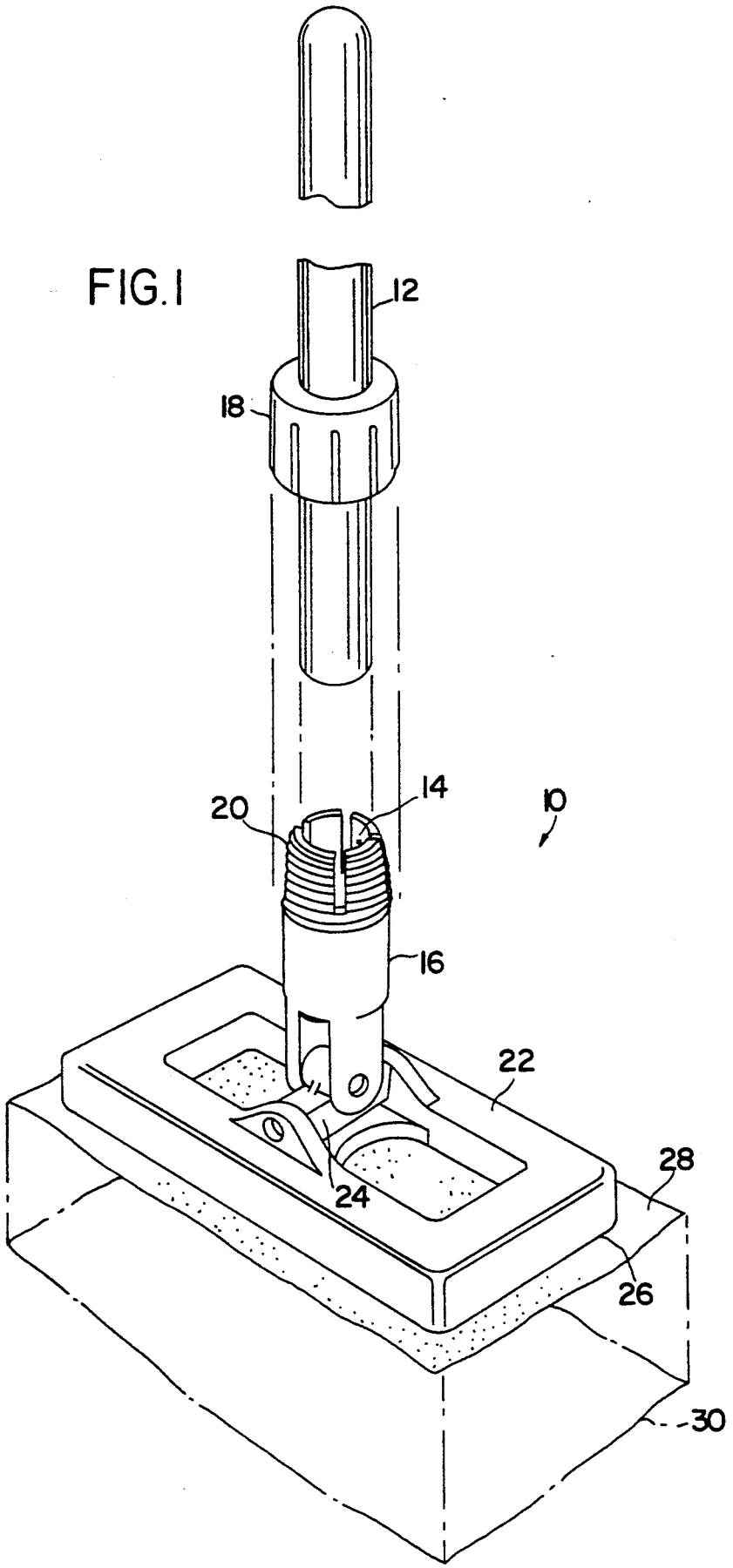
FIG. 1 is a partial assembly view of an apparatus constructed in accordance with the invention.

The apparatus 10 of the invention is shown in FIG. 1. A handle 12 is inserted into opening 14 of receptacle 16 and is secured by clamp 18. Clamp 18 is threadably received by threads 20. Pivotally attached by u-joint 24 to receptacle 16, and hence handle 12, is member 22. Member 22 has a generally flat lower surface 26. A cleaning fabric 28 between surface 26 and an area, like that shown at 30, to be cleaned provides the scrubbing surface. Fabric 28 has free edges illustrated at 29. Fabric 28 is preferably a non-woven fabric and can be any of the well-known type utilized as a pre-moistened wipe. An example of such a fabric is shown in U.S. Pat. No. 3,978,185. Another example is the wipe marketed at the retail level under the trademark SPIFFITS. These examples are hereby to be incorporated by reference.

Figure 2:
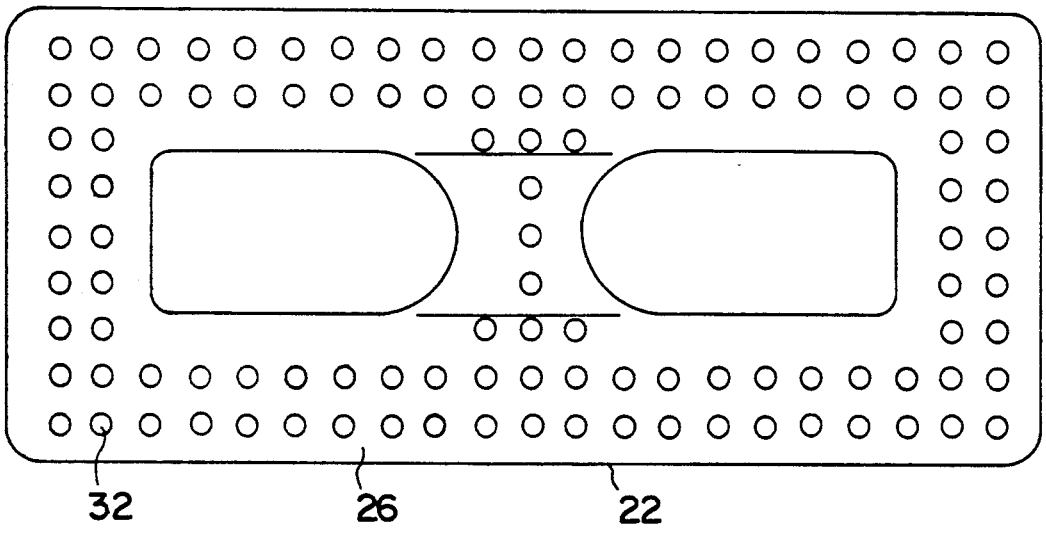
FIG. 2 is a plan view of the surface of the apparatus showing in detail the frictional means thereon.

Surface 26 is shown more clearly in FIG. 2. Frictional means, here a multiplicity of bristled areas, one of which has been designated 32 bristle areas, are provided on surface 26. The plurality of bristles comprising the bristle areas give surface 26 a higher coefficient of friction then the area to be cleaned. Fabric 28 is thus retained in position by frictional forces while free edges 29 are retained in a free state.

The process of the invention involves positioning the fabric 28 between surface 26 and area 30 and, then, moving handle 12 in a cleaning motion over area 30. The fabric 28 will be maintained in position by the user's application of pressure and the high coefficient of friction provided by the bristle areas. Since fabric 28 is pre-moistened, the area 30 is cleaned quickly and easily. Fabric 28 is then simply discarded.

It is thus apparent that the invention disclosed herein provides a means of mopping a floor without a mop bucket. As many variations will be apparent from a reading of the above description, such variations are embodied within the spirit and scope of this invention as defined by the following appended claims.

That which is claimed is:

1. A cleaning apparatus comprising:

a handle;

a member pivotally attached to an end of said handle having a generally flat surface, said surface having a frictional means; and a cleaning fabric having free edges frictionally maintained between said surface and an area to be cleaned.

2. The apparatus according to claim 1 wherein said frictional means is a plurality of bristles.

3. A process of cleaning a generally flat area comprising the steps of:

providing a cleaning apparatus comprising;

a handle; and a member pivotally attached to an end of said handle having a generally flat surface, said surface having a frictional means;

providing a cleaning fabric having free edges;

positioning said fabric between said surface and said area to be cleaned while retaining said edges in a free state; and moving said handle and thus said fabric in a cleaning motion over the area to be cleaned, whereby the fabric is maintained between said surface and said area due to the frictional means having a higher coefficient of friction than said area, thereby cleaning the area.

4. The apparatus according to claim 1 wherein said cleaning fabric is a premoistened fabric.

5. The process accordingly to claim 3 wherein said cleaning fabric is premoistened prior to said step of positioning.

* * * * *